United States Patent [19]

Bentivegna

[11] 3,964,574

[45] June 22, 1976

[54] LADDER LEVELING DEVICE

[76] Inventor: Pasquale P. Bentivegna, 56 Gladstone St., East Boston, Mass. 02128

[22] Filed: Oct. 29, 1974

[21] Appl. No.: 518,220

[52] U.S. Cl. ..... 182/204

[51] Int. Cl.[2] ..... E06C 7/44

[58] Field of Search ..... 182/204, 205, 194, 201, 182/108, 107

[56] References Cited

UNITED STATES PATENTS

| | | | |
|---|---|---|---|
| 388,076 | 8/1888 | Schmidt | 182/205 |
| 722,409 | 3/1903 | Paskell | 182/204 |
| 1,733,338 | 10/1929 | Enke | 182/204 |

FOREIGN PATENTS OR APPLICATIONS

| | | | |
|---|---|---|---|
| 901,224 | 7/1962 | United Kingdom | 182/205 |

*Primary Examiner*—Reinaldo P. Machado
*Attorney, Agent, or Firm*—Wolf, Greenfield & Sacks

[57] ABSTRACT

A ladder leveling device is attachable to a leg of a regular ladder having a joiner tongue affixed to the outer surface of said leg. Said device serves as an adjustable leg, having two sides, and a connector member between them that has slots extending diagonally therethrough adapted to receive said joiner tongue to thereby join my device to said ladder.

7 Claims, 7 Drawing Figures

LADDER LEVELING DEVICE

The principal object of my device is to provide an attachable device that serves as a supplementary leg to thereby lengthen, in effect, one leg of a ladder that is too short to reach the uneven surface of the ground or other supporting surface.

Another object is to provide said device with means that makes its position relative to a ladder leg changeable, so that where one of the regular ladder legs is too short to reach the lower part of the ground, it will provide whatever additional length is needed to so reach.

A further object is to make said device simple in construction so that it can be joined to a regular ladder in one simple movement by merely inserting a joiner tongue into a slot.

The foregoing and other objects which will appear as the nature of the invention is better understood, may be accomplished by a construction, combination and arrangement of parts such as is disclosed by the drawing. The nature of the invention is such as to render it susceptible to various changes and modifications, and therefore, I am not to be limited to the construction disclosed by the drawing, nor to the particular parts described in the specification; but am entitled to all such changes therefrom as fall within the scope of my invention. In the drawing.

Figure 1:
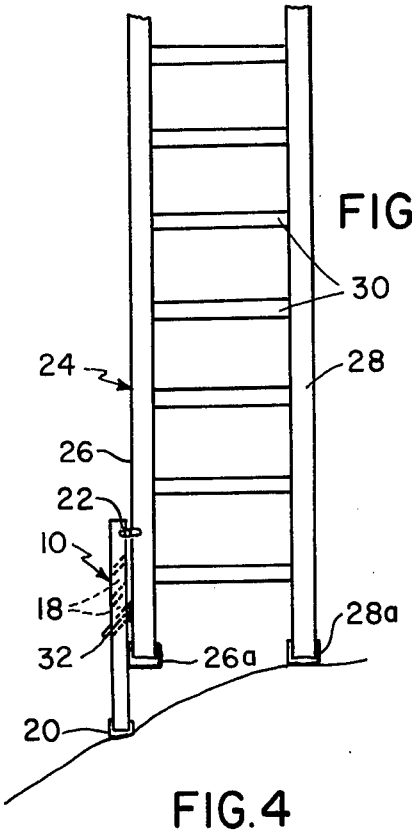
FIG. 1 is a front elevational view showing my device in position of use joined to a ladder and resting on an uneven surface indicated by the curved line at the bottom.
Figure 2:
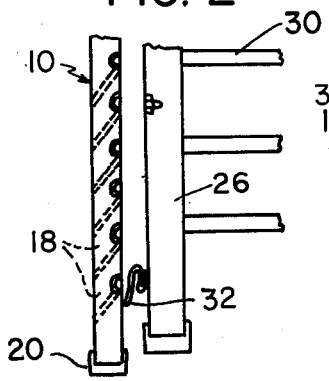
FIG. 2 is a fragmentary elevational view showing my device in position ready to be joined to a ladder leg.

As illustrated, my ladder leveling device 10 has two oppositely disposed sides 12 and 14 spaced laterally apart and shown with a connector member 16 extending between them. The latter is provided with a plurality of slots 18 that extend through said connector 16 diagonally downward. There are as many slots 18 as are needed to properly level a ladder.

At the bottom of said device 10 is a foot 20 that is attached thereto as by welding or by other-well-known means. Projecting fastener members, such as knobs 22 project outwardly from said side 12, and there may be another on said side 14, not shown. They may be punched out if my device is made of metal.

Figure 5:
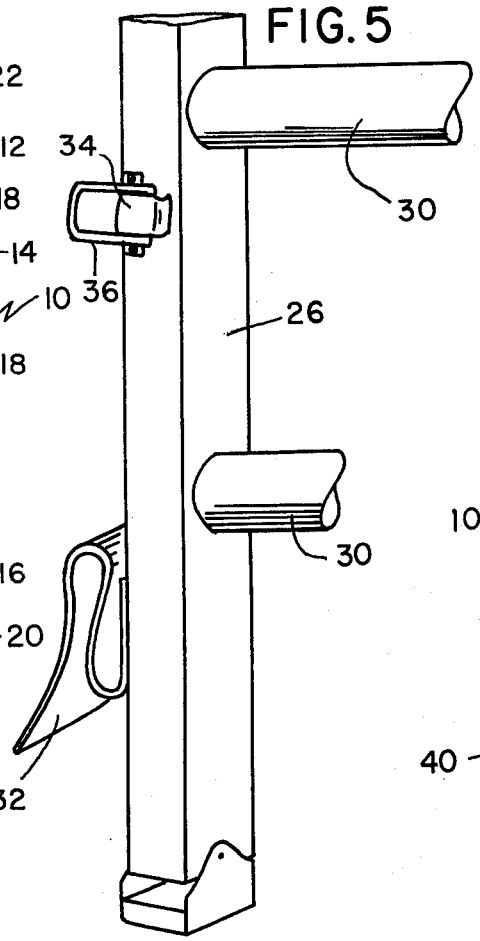
FIG. 5 is a fragmentary, perspective view of a regular ladder leg showing a joiner tongue attached to the outer side of said leg.

My device is atttachable to a well-known ladder 24 having two legs 26 and 28 spaced apart, having feet, 26*a* and 28*a* respectively, extending between them. A projecting joiner or entry tongue 32 extends from one said ladder leg, such as 26, as shown, diagonally downward and it is adapted to enter any one of said slots 18 to thus connect my device to the usual ladder 24. This joiner tongue 32 may be integral with said ladder leg 26 when made of metal; but if said ladder leg is made of wood, it is attachable thereto in any well-known way, as shown in said FIG. 5.

Figure 3:
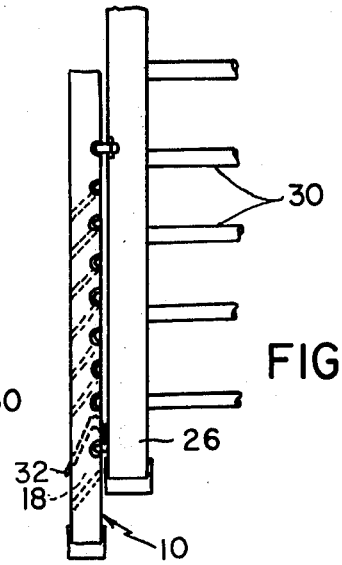
FIG. 3 is a view similar to FIG. 2; but showing the joiner tongue on a ladder leg extending into a slot in said device, thus joining the latter and the ladder.
Figure 4:
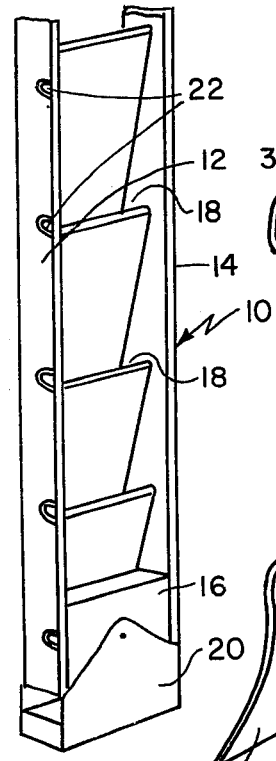
FIG. 4 is a fragmentary front perspective view of my device.

In the event the ground or other supporting surface slants or is otherwise uneven, said joiner tongue 32 is inserted into a said slot 18 in such a position that said device will extend downwardly beyond one of said ladder legs, such as 26, as shown in said FIG. 1 and 3.

Figure 6:
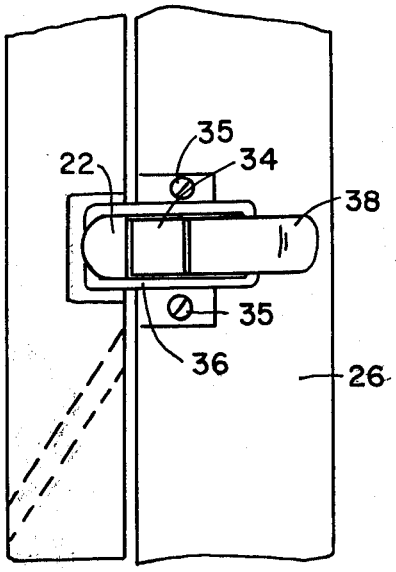
FIG. 6 is a fragmentary view of my device joined to a ladder leg, showing two fastener members in connected position to hold my device and the ladder leg firmly together.

To firmly hold said ladder and device in joined position I provide a fastener member 34, attached as by screws 35 or by welding or otherwise, to one or more sides of one of said ladder legs, as shown in said FIG. 6. Each fastener member 34 has a pivoting loop member 36 which may be swung over to and extend around said fastener knob 22 as shown in said FIG. 6. A clamp 38 holds said loop member 36 down, to thus more firmly hold said device and ladder leg together.

Figure 7:
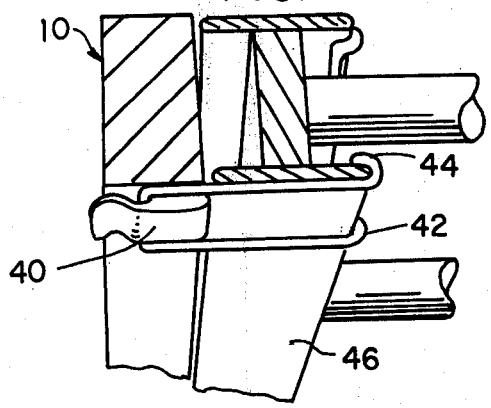
FIG. 7 is a fragmentary, perspective view showing a metal ladder with two modified fastener members in connected position to hold the ladder leg and my device firmly together.

In said FIG. 7 I show a fastener 40 that is attached to a ladder leg 46, as by welding, and it has a pivoting loop member 42 that has a hook member 44 at one end extremity. This loop member 42 extends over said ladder leg 46 which in fastened position, as shown, and the hook member 44 extends rearwardly of the ladder and is attached to said ladder leg 46.

What I claim is:

1. A ladder leveling device for attachment to a ladder having two legs spaced laterally apart and a number of rungs spacedly extending between the legs, said device comprising, in combination;

two oppositely disposed sides, a foot arranged at the bottom end of the sides and extending between the sides to at least partially support the sides in an upright substantially parallel position, a plurality of connector walls coupled between the sides in spaced apart relationship and tilted at an angle to the vertical to provide slots at predetermined heights of the device, a tongue means having a downwardly depending end secured to a side surface of one of the legs of the ladder at the lower end of the one leg, said tongue means for fitting with one of said connector walls with the depending end fitting within one of the slots, said sides, foot and connector walls forming a unitary structure interlocked by said tongue means adjacent the one leg, and fastener means including two parts, one secured to said one leg above the tongue means and the other part secured to one of said sides.

2. A ladder leveling device as set forth in claim 1 wherein the foot comprises a block having a flat rest surface.

3. A ladder leveling device as set forth in claim 2 wherein the tongue means is in the form of an S-shaped tongue defining, in addition to the depending end, a slot for engagement with the connector wall.

4. A ladder leveling device as set forth in claim 3 wherein the tongue means and said one part of the fastener are spaced apart about the distance between adjacent rungs of the ladder.

5. A ladder leveling device as set forth in claim 4 wherein the one part includes a loop member and the other part includes a knob.

6. A ladder leveling device as set forth in claim 5 including a plurality of knobs disposed at spaced intervals along the one side.

7. A ladder leveling device as set forth in claim 6 wherein the tongue also has a flat end which is secured to the ladder.

* * * * *